US006761478B2

(12) United States Patent
Schmiedchen et al.

(10) Patent No.: US 6,761,478 B2
(45) Date of Patent: Jul. 13, 2004

(54) CHRONOGRAPH WITH TWO ROTATIONAL DIRECTIONS

(75) Inventors: Christian Schmiedchen, Reichstädt (DE); Patrick Streubel, Heidenau (DE)

(73) Assignee: Glashütter Uhrenbetrieb GmbH, Glashutte/Sachsen (DE)

( * ) Notice: Subject to any disclaimer, the term of this patent is extended or adjusted under 35 U.S.C. 154(b) by 253 days.

(21) Appl. No.: 10/130,508

(22) PCT Filed: Mar. 21, 2001

(86) PCT No.: PCT/EP01/03349

§ 371 (c)(1),
(2), (4) Date: May 20, 2002

(87) PCT Pub. No.: WO02/077725

PCT Pub. Date: Oct. 3, 2002

(65) Prior Publication Data

US 2004/0022133 A1 Feb. 5, 2004

(51) Int. Cl.[7] ..... G04F 7/00

(52) U.S. Cl. ..... 368/101; 368/106; 368/110; 368/113

(58) Field of Search ..... 368/101–106, 368/110–113

(56) References Cited

U.S. PATENT DOCUMENTS 2,028,452 A 1/1936 Hofer
3,901,020 A 8/1975 Capt et al.
5,113,382 A 5/1992 Bron
5,220,541 A * 6/1993 Vuilleumier ..... 368/88
5,280,460 A * 1/1994 Bron ..... 368/106
5,793,708 A * 8/1998 Schmidt et al. ..... 368/106
6,406,176 B1 * 6/2002 Takahashi et al. ..... 368/101

FOREIGN PATENT DOCUMENTS

CH 207 2/1889
CH 32 459 7/1905

* cited by examiner

*Primary Examiner*—Vit W. Miska
(74) *Attorney, Agent, or Firm*—Sughrue Mion, PLLC

(57) ABSTRACT

There is disclosed a chronograph mechanism capable of operating either in the conventional direct direction, or in the opposite direction to perform a countdown. The seconds counter (80) has a control finger (85) for incrementing and decrementing the minutes counter (11). In order to prevent the control finger acting at the start of a revolution of the seconds counter during a countdown, it is mounted so as to pivot on a disc (91) of the counter. Two pins (95, 96), which can be indexed and are fixed onto the disc, abut against the respective flanks of the control finger to drive it only at the end of a revolution, respectively in one direction or the other. A spring (97) keeps the finger from meshing with the transmission wheel (84) when the countdown time interval is being pre-selected.

14 Claims, 4 Drawing Sheets

CHRONOGRAPH WITH TWO ROTATIONAL DIRECTIONS

Figure 1:
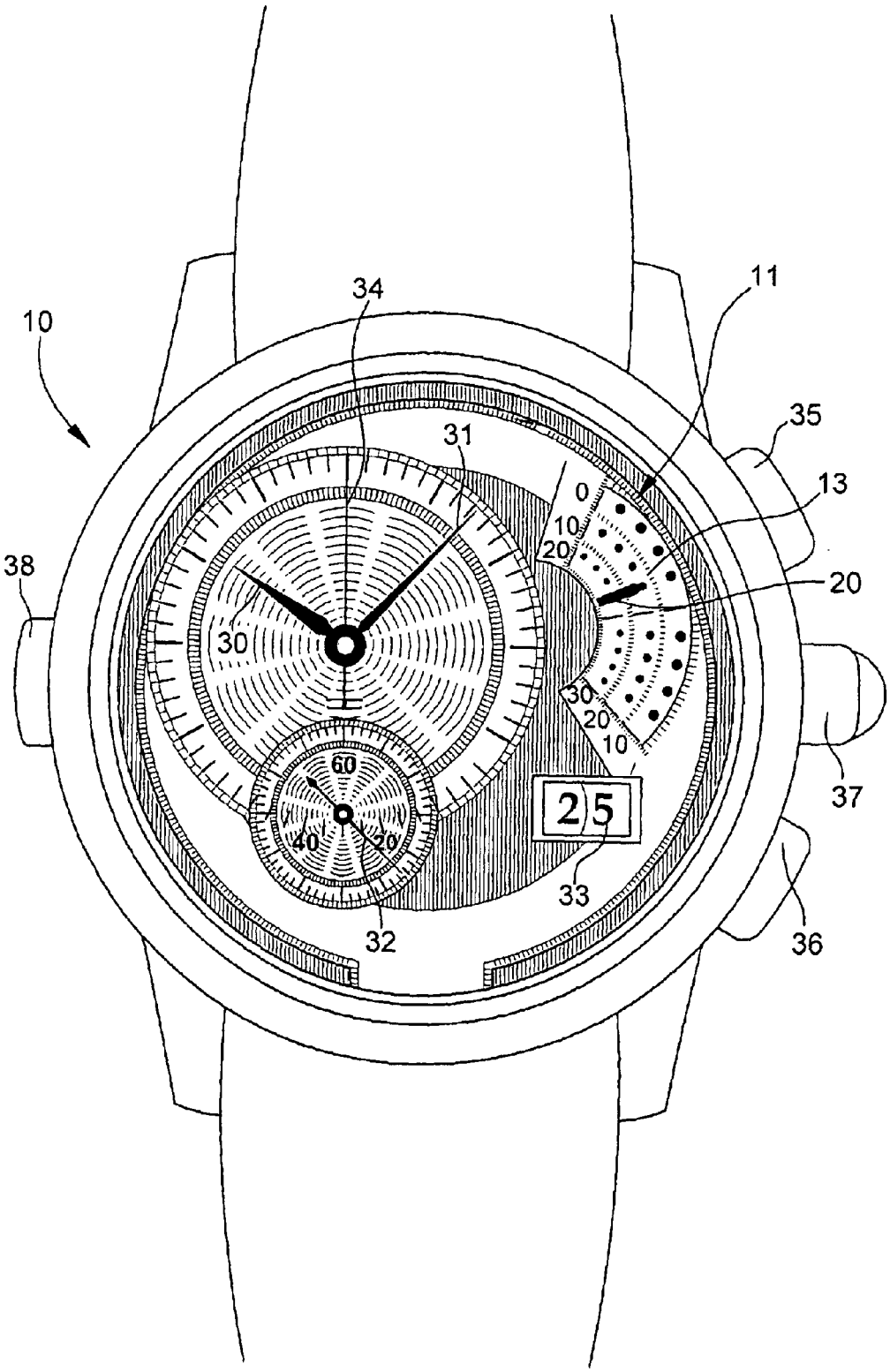

This is a National stage entry under 35 U.S.C. §371 of Application No. PCT/EP01/03349 filed Mar. 21, 2001, the disclosure of which is incorporated herein by reference.

The present invention concerns a chronograph including a device for driving a second counter by a first counter, the second counter being arranged for counting the revolutions made by the first counter from a zero position of the first counter, the drive device including a control finger mounted on the first counter and capable of meshing with a transmission wheel associated with the second counter for driving the latter.

In most cases, the counter referred to above as the first counter is a seconds counter and the second counter is a minutes counter, for example as provided by Swiss Patent No. 571 741 (corresponding to U.S. Pat. No. 3,901,020). However, a similar drive device can be used with different counters, for example for driving an hours counter from a minutes counter.

When the counters of a mechanical chronograph are reset to zero, the rotating wheel sets of the counters have to be able to rotate easily and quickly. The aforementioned control finger is liable to interfere with the toothing of the transmission wheel. A known solution for avoiding this problem is moving the transmission wheel so that it is out of reach of the finger while the first counter returns to its zero position. For example in Swiss Patent No. 678 911 (corresponding to U.S. Pat. No. 5,113,382), the control finger meshes with an intermediate wheel, which is permanently meshed with a wheel of the minutes counter. This intermediate wheel is raised axially by the zero reset command, to move it out of the trajectory of the control finger.

The present invention improves the device for driving the second counter by the first so as to enable it to operate in two opposite directions, namely a direct direction in which the chronograph adds time in a conventional manner, and a reverse direction in which the chronograph counts down, in particular a time which the user has pre-selected by putting at least one of the counters in a start position which defines said countdown time interval.

This double rotational direction creates a new problem linked to the meshing of the control finger with the transmission wheel. Let us assume for the sake of simplification that the seconds counter is initially at its zero position both for a countdown and for conventional counting by addition. If the control finger is fixed to the seconds counter as in the aforementioned Patents, its initial position has to be such that it will move the transmission wheel forward and thus increment the minutes counter at the moment when the seconds counter and the finger finish one complete revolution forwards, which corresponds to 60 seconds. However, this position would not be suitable in the case of a countdown, since the finger would then act on the transmission wheel shortly after the start of its rotation backwards, i.e. already after several seconds, which would produce an erroneous reading for the minutes counter.

The present invention concerns a chronograph with two rotational directions, wherein the aforementioned drive device is made so as to activate the second counter at a precise moment at the end of a revolution of the first counter, in both directions. An additional object is to enable precise angular indexing of the control finger with respect to the other components of the device, in order to adjust precisely the moment at which it will act on the toothing of the transmission wheel. Another additional object consists in arranging the transmission device so as to avoid interference between the control finger and the transmission wheel during pre-selection of the duration of the countdown interval. These objects are intended to be achieved via a simple and compact construction.

According to the invention, there is provided a chronograph of the type indicated in the preamble hereinbefore, characterised in that the first and second counters are capable of rotating in both directions, respectively in an adding mode and in a countdown mode, the second counter being driven forwards or backwards depending on the rotational direction of the first counter, in that the control finger is mounted so as to pivot on a disc linked to a rotating shaft of the first counter and in that the disc and the control finger are coupled to each other by drive means enabling the control finger to pivot on the disc between two stop positions set apart by an angle close to 360°.

This enables the control finger to occupy one or other of the two stop positions, depending on the direction of rotation, at the moment when it has to start to drive the transmission wheel at the end of a complete revolution of the first counter. The drive means, which define these two stop positions, may advantageously be arranged to allow precise indexing of these positions.

Preferably, the disc is secured to the shaft of the first counter in an indexed angular position with respect to a zero reset heart-piece, by means of which said zero position is defined, and the disc is provided with a spring arranged to keep the control finger free of the transmission wheel when the first counter is at the zero position. With this construction, the aforementioned drive means are preferably adjustable for indexing said stop positions with respect to the zero reset heart-piece.

Figure 2:
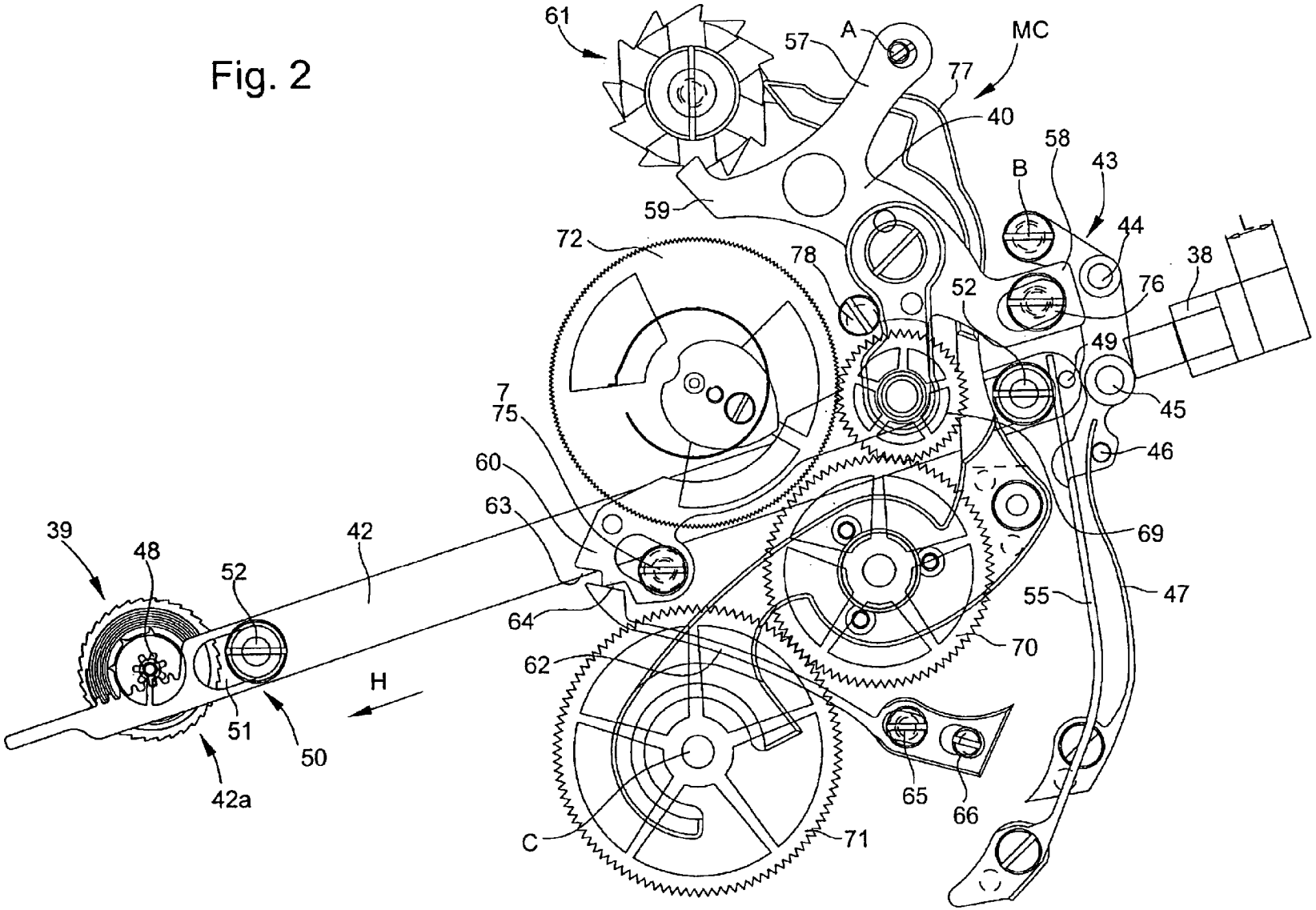
Figure 4:
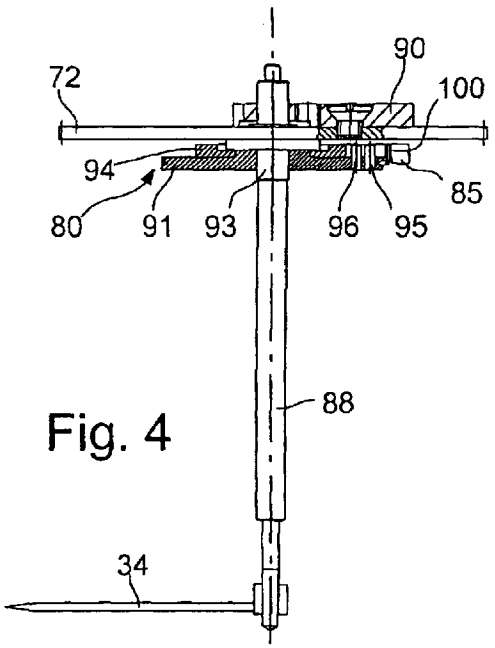
Figure 3:
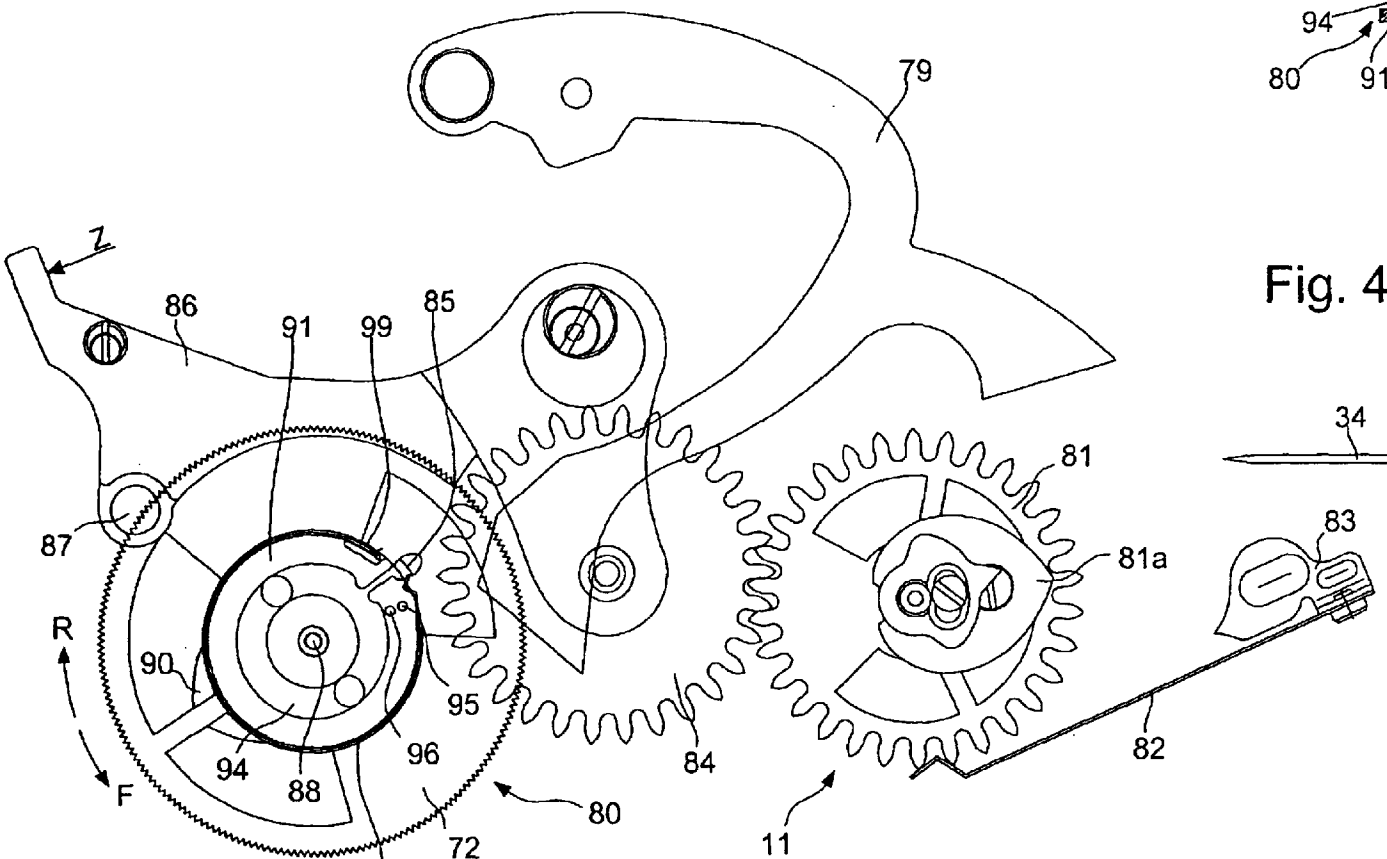
Figure 5:
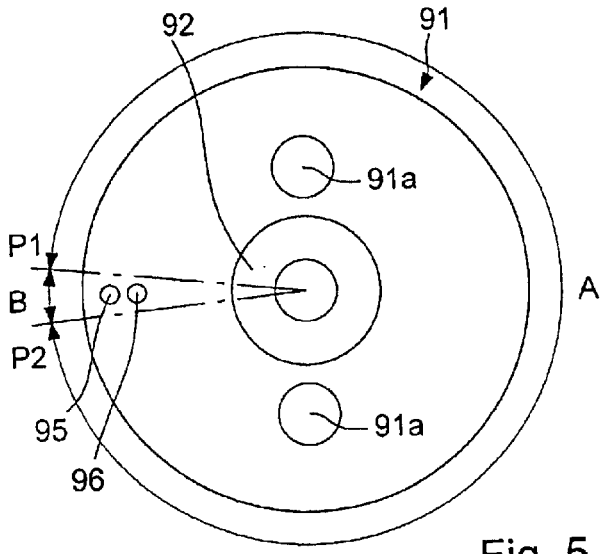
Figure 7:
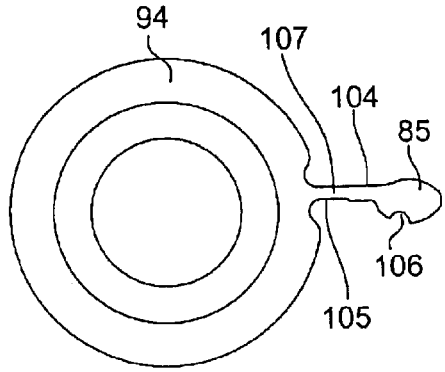
Figure 6:
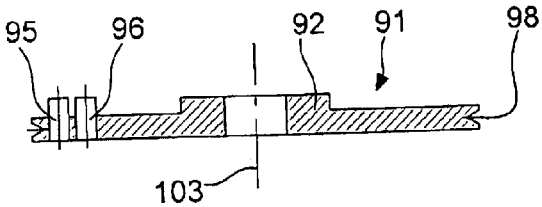
Figure 8:
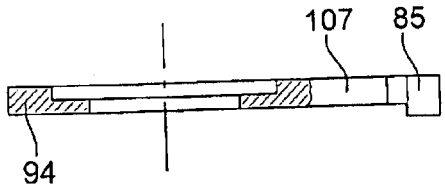
Figure 9:
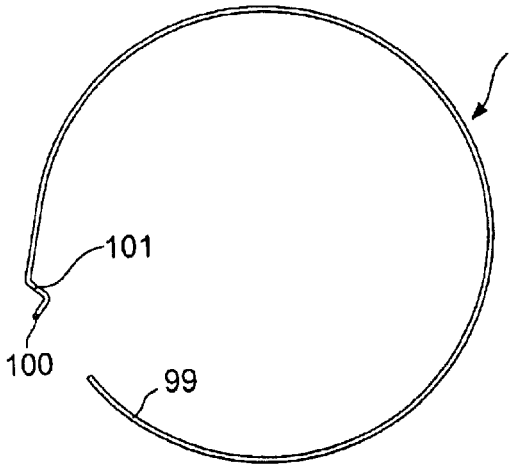
Figure 10:
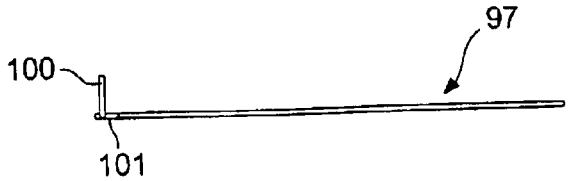

Other features and advantages of the present invention will appear in the following description of a preferred embodiment, given by way of non limiting example with reference to the annexed drawings, in which:

FIG. 1 shows a wristwatch including a timekeeper and a chronograph with two rotational directions according to the invention, FIG. 2 shows the mechanism for starting the countdown, FIG. 3 shows the elements of the seconds and minutes counters of the chronograph, seen from the opposite side of the watch dial, FIG. 4 is a lateral view of the seconds counter, FIG. 5 is a plan view of a disc of the seconds counter, FIG. 6 is a cross-section along the line VI-VI of FIG. 5, FIG. 7 is a plan view of another element of the seconds counter, FIG. 8 is a lateral view in partial cross-section of the element of FIG. 7, FIG. 9 is a plan view of a spring of the seconds counter, and FIG. 10 is a lateral view of the spring of FIG. 10.

FIG. 1 is a face view of a timepiece formed by a wristwatch 10 provided with a mechanical watch movement including a timekeeper and a chronograph. This watch includes timekeeper hands, namely an hours hand 30, a minutes hand 31 and a small seconds hand 32. A calendar with a large aperture 33 completes the timekeeper. The chronograph includes a seconds counter provided with a hand 34, and a minutes counter 11. The chronograph is started then stopped, to measure time in a conventional manner, by means of a first push-button 35. A second push-button 36 resets the seconds and minutes counters to zero. A crown 37 fixed to a control stem enables the watch to be rewound, the calendar to be updated and the timekeeper hands to be set to the correct time, depending on the axial positions to which the crown is moved.

In watch 10, the chronograph is also used as a timer or for counting down time, the pre-selection of the countdown time interval being made by the user by means of crown 37 so as to rotate minutes counter 11 until it indicates the desired countdown time interval, expressed as an integer number of minutes. The countdown is started and a spring barrel, activating a striking mechanism indicating the end of the countdown, is rewound by pressing a third push-button 38. As FIG. 1 shows, minutes counter 11 includes a dial 13 situated behind an aperture and including three concentric scales each of ten minutes, which each extend over 120°. In front of dial 13, the shaft of minutes counter 11 carries three hands of different lengths, arranged at 120° with respect to each other and respectively associated with said three scales. Only one of these hands, designated by the reference 20, is visible in FIG. 1 where it indicates presently 14 minutes.

Watch 10 further includes a striking mechanism driven by an auxiliary barrel and controlled by the chronograph, the striking mechanism being activated at the end of a pre-selected time interval which is counted down by the chronograph, which is then driven in the opposite direction to the usual direction. The auxiliary barrel thus provides the mechanical energy necessary to activate the strike hammers of the striking mechanism, which will not be described in more detail here, whereas the main barrel provides the mechanical energy necessary to drive the watch movement and chronograph.

FIG. 2 shows mechanical control means MC activated by push-button 38 and arranged to simultaneously start the countdown and wind the spring of auxiliary barrel 39. For this purpose, control means MC include a control lever 40 pivoted at A on the plate of the movement (not shown), to start the countdown, and a winding bar 42, which extends through the movement between push-button 38 and auxiliary barrel 39 to wind the latter. When it is pressed, push-button 38 makes a travel L and simultaneously acts on lever 40 and on winding bar 42 via a lever 43 articulated at B, provided with pins 44, 45 and 46 and associated with a return spring 47.

Winding bar 42 has at its distal end a rack 42*a* which meshes with a pinion 48 connected to the shaft of auxiliary barrel 39, whereas its proximal end co-operates with pin 45 of articulated lever 43. The winding bar is guided in translation on studs 52 secured to the movement plate. A movement in translation by winding bar 42 via the action of push-button 38 via lever 43 drives pinion 48, which winds the spring of auxiliary barrel 39. When the auxiliary barrel rotates to drive the striking mechanism, it returns bar 42 to its initial position using a return spring 55 which acts on a pin 49 of the bar.

Lever 40 includes a body from which four arms 57, 58, 59 and 60 extend. Lever 40 is articulated in a conventional manner at the end of its first arm 57 on the movement plate. The free end of the second arm 58 extends facing pin 44 of lever 43. Third arm 59 co-operates with a column wheel 61 controlled by a device (not shown) connected to push buttons 35 and 37 (FIG. 1). Fourth arm 60 co-operates via its free end with a jumper spring 62, which enables two pre-defined positions of lever 40 to be indexed. In order to achieve this indexing, the free end of the fourth arm includes two notches 63 and 64 in which the end of jumper 62 engages. The tension of jumper 62 and its position with respect to notches 63 and 64 can be adjusted by means of a screw 65 and a cam 66 co-operating respectively with two oblong holes arranged in an end of spring 62.

It will be noted that the free ends of arms 58 and 60 each include an oblong hole engaged on a corresponding stud 75, 76 in order to assure precise guiding of lever 40 and to hold it against the plate.

Arm 60 further includes an inverter wheel 69 permanently meshed with a chronograph wheel 70 which is carried by a chronograph lever 77 pivoted at C. Wheel 70 permanently meshes with a wheel 71 the axis of which carries small seconds hand 32, this wheel 71 being driven by the watch movement. Depending on the position of lever 40, the inverter wheel is engaged on or released from a wheel 72 of the seconds counter, which drives the seconds hand 34 of the chronograph.

Column wheel 61 is arranged, on the one hand, for locking lever 40 into a position in which inverter wheel 69 is released from wheel 72 when the counting by addition function of the chronograph is started, and on the other hand, for locking chronograph lever 77 into a position in which wheel 70 is released from wheel 72 when the chronograph countdown function is started. Lever 40 co-operates with an eccentric stop 78, which enables the depth of penetration of the teeth of inverter wheel 69 in the toothing of wheel 72 of the chronograph seconds counter to be adjusted.

Minutes counter 11 and seconds counter 80 of the chronograph will now be described with more particular reference to FIGS. 3 to 10. FIG. 3 shows that wheel 81 of minutes counter 11 is a wheel with 30 teeth, provided with a zero reset heart-piece 81*a* and associated with a jumper 82 fixed to the plate via a support 83. This wheel meshes with an intermediate transmission wheel 84 which is driven by a control finger 85 of seconds counter 80. Transmission wheel 84 is carried by a lever 86 mounted on a pivot 87, to be selectively released from wheel 81 and from the trajectory of finger 85 by a movement of the lever. This movement is generated by pressure along the arrow Z when the chronograph is reset to zero.

Wheel 72 of seconds counter 80 is fixed to a shaft 88 carrying chronograph seconds hand 34. A zero reset heart-piece 90 is fixed to wheel 72 to define its zero position in a conventional manner, owing to a strike hammer 79. On the other side of wheel 72, a disc 91 having a central hub 92 is adjusted on a cylindrical shoulder 93 of shaft 88, such that it can be rotated by force to index its angular position with respect to that of heart-piece 90. This indexing is achieved by means of a wrench engaging in two holes 91*a* of disc 91.

Between disc 91 and wheel 72, a ring 94 provided with control finger 85 is mounted so as to pivot freely about hub 92 of disc 91. In order to co-operate with control finger 85, disc 91 is provided with drive means, formed in this example by two pins 95 and 96, and a holding spring 97 intended to keep finger 85 from meshing with wheel 84 when the seconds counter is in the zero position. This spring, shown separately in FIGS. 9 and 10, is formed by steel wire bent in an arc of a circle, guided by a peripheral groove 98 of disc 91 and having a first end 99 fixed in said groove, for example by bonding. The other end of spring 97 is bent at a right angle, as shown in FIGS. 9 and 10, to form an axial stem 100 with respect to the disc. At the base of this stem, the spring forms a beak 101 intended to engage in groove 98. In the rest position, spring 97 rests slightly on the bottom of groove 98.

The two pins 95 and 96 are substantially parallel to shaft 88 and are located substantially on the same radial line of disc 91, but at different distances from axis 103 of the disc and the shaft. These pins are driven into respective holes in the disc, from which they project beside ring 94. They are preferably made of brass, so that they can be bent. Pin 95 is intended to abut against a first flank 104 (see FIG. 7) of finger 85, and the other pin 96 is intended to abut against the opposite flank 105 of finger 85. It will also be noted that finger 85 has a lateral recess 106 intended to receive stem 100 of spring 97.

Pins 95 and 96 thus define stop positions for control finger 85, in which the finger is respectively on one side or other of the drive means formed by the two pins. These positions are indexed with respect to heart-piece 90 of the seconds counter, first the by positioning of plate 91, then more precisely by bending each pin 95 and 96 laterally if necessary. Two very precise positions P1 and P2 of finger 85 are thus defined (see FIG. 5), angularly set apart by an angle A slightly less than 360°, this angle being determined by the relative positions of pins 95 and 96 on the one hand, and flanks 104 and 105 of the finger on the other hand. The angle B shown in FIG. 5 is equal to 360° minus A. Its value is preferably equal to the angle, which produces a rotation corresponding to one minute on the minutes counter. With the 30 minutes counter used in the present example, this angle B is substantially equal to 12°, so that A=348°.

As a result of this arrangement, the active travel of finger 85 in the backwards direction to decrement the minutes counter is effected after the same rotational angle of the seconds counter, from the zero position, as the active travel of the finger in the forwards direction to increment the minutes counter.

It will be noted that the two pins 95 and 96 could be replaced by a single drive element. However, the use of two pins is advantageous for two reasons. On the one hand, it enables very precise indexing of the two stop positions of the control finger, by bending the pins as explained hereinbefore. On the other hand, it enables angle B to be reduced to a very small value, or even zero, if the base part 107 of finger 85 is given a sinuous shape such that its flanks 104 and 105, which are offset radially in relation to each other, can be closer in a circumferential direction than in FIG. 7. If base 107 were Z-shaped, flank 105 could even be located higher than flank 104 in FIG. 7, so that the two stop positions of the finger could be identical, i.e. offset by 360° exactly.

In a variant, pins 95 and 96 could be fixed to ring 94 and engaged in respective grooves of disc 91. However, the embodiment shown in the drawings is more advantageous because it allows easy access to pins 95 and 96 through openings in wheel 72 to adjust them by bending.

It will also be noted that in certain variants, disc 91 could be integrated either in wheel 72, or in heart-piece 90. Peripheral spring 97 should then be replaced by a spring arranged in a cavity of the disc.

The chronograph mechanism shown in FIGS. 3 and 4 operates in the following manner, seconds counter 80 being initially set to its zero position shown in FIG. 3.

In the conventional adding timing mode, the entire assembly shown in FIG. 4 rotates forwards in the direction of arrow F of FIG. 3, wheel 72 of counter 80 being driven by chronograph wheel 70 shown in FIG. 2. Drive finger 85 is driven in rotation by spring 97 until it abuts against a tooth of transmission wheel 84, which is held stopped by wheel 81 of the minutes counter and by jumper 82. Spring 97, which is too weak to overcome the effect of jumper 82, bends outwards. As soon as pin 96 abuts against the corresponding flank of finger 85, it drives the latter positively and forces it to make wheels 84 and 81 move forward one tooth (i.e. 12° in the present example) at the end of a complete revolution of seconds counter 80, i.e. during the sixtieth second, which increments minutes counter 11 by one minute. This operation is repeated at each revolution of seconds counter 80.

In the countdown mode, seconds counter 80 is driven in the direction of arrow R by inverter wheel 69 shown in FIG. 2. Control finger 85 is then no longer pressed by spring 97 and can pivot via the effect of friction until it abuts against a tooth of transmission wheel 84. Just before the end of a complete revolution of seconds counter 80, pin 95 will abut against the corresponding flank of finger 85 and force it to make wheels 84 and 81 move back one tooth overcoming the force of jumper 82, so that minutes counter 11 is decremented by one minute at each sixtieth second of the countdown.

The chronograph is reset to zero by pressure on pushbutton 36 which first of all makes lever 86 pivot to release transmission wheel 84 of the two counters 11 and 80, then makes strike hammer 79 press in a conventional manner on heart-pieces 81*a* and 90 of the two counters and return them to their zero position. During this operation, control finger 85 can occupy any position.

The preceding description shows that the present invention, owing to an improved, but simple and compact construction of the seconds counter, enables a chronograph to be made which is capable of operating not only conventionally via addition, but also by subtraction in order to perform a countdown.

What is claimed is:

1. A chronograph including a device for driving a second counter by a first counter, said second counter being arranged for counting the revolutions made by said first counter from a zero position of said first counter, said drive device including a control finger mounted on said first counter and capable of meshing with a transmission wheel associated with said second counter, wherein said first and second counters are capable of rotating in both directions, respectively in an adding mode and in a countdown mode, said second counter being driven forwards or backwards depending on the rotational direction of said first counter, wherein said control finger is mounted so as to pivot on a disc linked to a rotating shaft of said first counter and wherein said disc and said control finger are coupled to each other by drive means enabling said control finger to pivot on said disc between two stop positions set apart by an angle close to 360°.

2. The chronograph according to claim 1, wherein said disc is fixed to said shaft of the said counter in an angular position which is indexed with respect to a zero reset heart-piece, by means of which said zero position is defined, and wherein said disc is provided with a spring arranged to keep said control finger free of said transmission wheel when said first counter is in the zero position.

3. The chronograph according to claim 2, wherein said drive means can be adjusted to index said stop positions with respect to said zero reset heart-piece.

4. The chronograph according to claim 1, wherein said stop positions are set apart by an angle equal to 360° less a predefined angle substantially corresponding to a given number of units of said first counter.

5. The chronograph according to claim 4, wherein said given number of units is equal to one.

6. The chronograph according to claim 4, wherein said predefined angle ranges from zero to twelve degrees.

7. The chronograph according to claim 1, wherein said drive means include two pins fixed to said disc and arranged to abut respectively against opposite flanks of said control finger.

8. The chronograph according to claim 7, wherein said pins are substantially parallel to said shaft and are offset radially with respect to each other.

9. The chronograph according to claim 7, wherein said drive means can be adjusted by deforming said pins.

10. The chronograph according to claim 2, wherein said control finger is secured to a ring arranged between said disc and a wheel fixed to said shaft of said first counter, said zero reset heart piece being arranged on said wheel on the opposite side to said ring.

11. The chronograph according to claim 10, wherein said drive means include two pins fixed to said disc and arranged to abut respectively against opposite flanks of said control finger and wherein said pins are accessible through said wheel from the side of the zero reset heart-piece.

12. The chronograph according to claim 2, wherein said spring extends over an arc of a circle about the periphery of the disc, to which a first end of said spring is fixed, its other end having an axial stem so as to be able to press laterally against said control finger.

13. The chronograph according to claim 1, wherein said transmission wheel is an intermediate wheel mounted on a lever so as to be selectively meshed with a wheel of said second counter and released therefrom by a movement of said lever.

14. The chronograph according to claim 1, wherein said first counter is a seconds counter and said second counter is a minutes counter.

* * * * *